US012390071B2

(12) United States Patent
Amaral et al.

(10) Patent No.: US 12,390,071 B2
(45) Date of Patent: Aug. 19, 2025

(54) EVACUATION STATION WITH DEBRIS SEPARATION

(71) Applicant: iRobot Corporation, Bedford, MA (US)

(72) Inventors: Erik Amaral, Bolton, MA (US); Charles Hudson, Salem, NH (US)

(73) Assignee: iRobot Corporation, Bedford, MA (US)

( * ) Notice: Subject to any disclaimer, the term of this patent is extended or adjusted under 35 U.S.C. 154(b) by 323 days.

(21) Appl. No.: 18/076,718

(22) Filed: Dec. 7, 2022

(65) Prior Publication Data

US 2024/0188780 A1 Jun. 13, 2024

(51) Int. Cl.
*A47L 9/28* (2006.01)
*A47L 9/00* (2006.01)

(52) U.S. Cl.
CPC ..... *A47L 9/2873* (2013.01); *A47L 9/0063* (2013.01); *A47L 2201/024* (2013.01)

(58) Field of Classification Search
CPC ... A47L 9/10; A47L 9/106; A47L 9/14; A47L 9/149; A47L 9/1683; A47L 9/2873; A47L 9/0063; A47L 2201/00; A47L 2201/02; A47L 2201/024
See application file for complete search history.

(56) References Cited

U.S. PATENT DOCUMENTS

2023/0172415 A1* 6/2023 Park ..... A47L 9/248 15/319

FOREIGN PATENT DOCUMENTS

CN 113558525 A * 10/2021

* cited by examiner

*Primary Examiner* — C. A. Rivera
(74) *Attorney, Agent, or Firm* — Schwegman Lundberg & Woessner, P.A.

(57) ABSTRACT

A docking station for a mobile cleaning robot can include a base configured to receive at least a portion of the mobile cleaning robot thereon, where the base can include a debris port. The docking station can include a canister connected to the base and located at least partially above the base. The canister can include a debris bin to receive debris from the mobile cleaning robot. The canister can include a debris duct connected to the debris port and to the debris bin. The canister can include a debris collector connected to the debris duct upstream of the debris bin, where the debris collector can collect debris from a debris airstream of the debris duct.

18 Claims, 13 Drawing Sheets

EVACUATION STATION WITH DEBRIS SEPARATION

BACKGROUND

Autonomous mobile robots include autonomous mobile cleaning robots that can autonomously perform cleaning tasks within an environment, such as a home. Many kinds of cleaning robots are autonomous to some degree and in different ways. Some robots can interface with a docking station automatically. The docking station can perform maintenance on the robot such as charging of batteries of the robot and evacuation of debris from a debris bin of the robot.

SUMMARY

Mobile cleaning robots can include a variety of components that require maintenance or interaction between missions or during missions. For example, vacuuming robots that extract debris from an environment may need to empty their debris bins during missions or between missions. However, because of autonomous vacuuming, mobile cleaning robots may ingest items that are not desired to be ingested, such as children's toys, screws, office supplies, or jewelry.

This disclosure helps to support these operations by including a docking station that includes features for separation of large or heavy debris. The docking station can be configured to automatically evacuate debris from the mobile cleaning robot during (or following vacuuming operations). During evacuation, the docking station can collect relatively large or heavy items in a debris collector that can be viewed or accessed by a user, such as for removal of non-debris items that were ingested by the robot (and later evacuated). In this way, the docking station can help users avoid disposing of non-debris items that were ingested by the mobile cleaning robot.

For example, a docking station for a mobile cleaning robot can include a base configured to receive at least a portion of the mobile cleaning robot thereon, where the base can include a debris port. The docking station can include a canister connected to the base and located at least partially above the base. The canister can include a debris bin to receive debris from the mobile cleaning robot. The canister can include a debris duct connected to the debris port and to the debris bin. The canister can include a debris collector connected to the debris duct upstream of the debris bin, where the debris collector can collect debris from a debris airstream of the debris duct.

The above discussion is intended to provide an overview of subject matter of the present patent application. It is not intended to provide an exclusive or exhaustive explanation of the invention. The description below is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
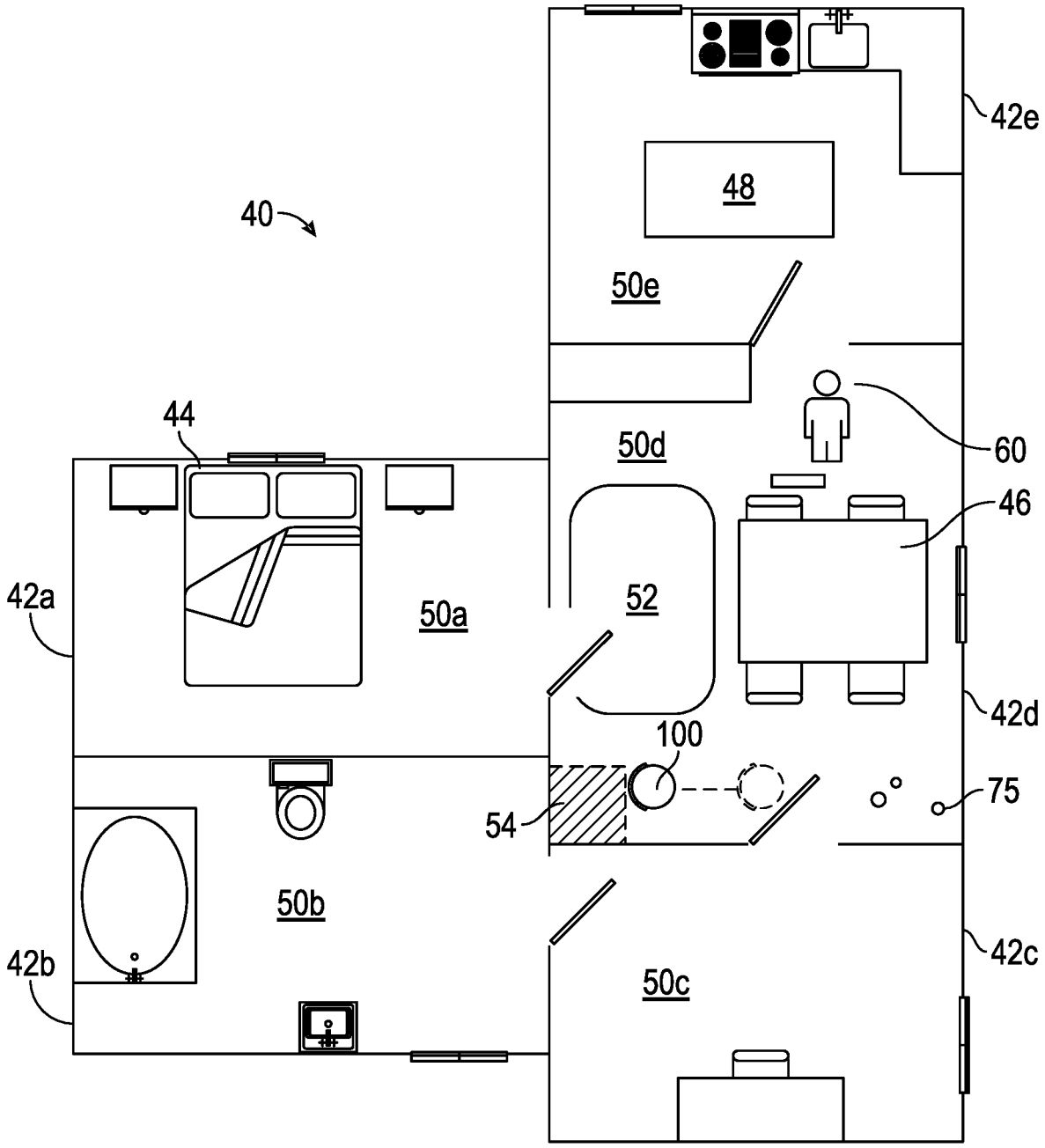
FIG. 1 illustrates a plan view of a mobile cleaning robot in an environment.

FIG. 1 illustrates a plan view of a mobile cleaning robot 100 in an environment 40, in accordance with at least one example of this disclosure. The environment 40 can be a dwelling, such as a home or an apartment, and can include rooms 42*a*-42*e*. Obstacles, such as a bed 44, a table 46, and an island 48 can be located in one or more of the rooms 42 of the environment. Each of the rooms 42*a*-42*e* can have a floor surface 50*a*-50*e*, respectively. Some rooms, such as the room 42*d*, can include a rug, such as a rug 52. The floor surfaces 50 can be of one or more types of flooring, such as hardwood, ceramic, low-pile carpet, medium-pile carpet, long (or high)-pile carpet, stone, or the like.

The mobile cleaning robot 100 can be operated, such as by a user 60, to autonomously clean the environment 40 in a room-by-room fashion. In some examples, the robot 100 can clean the floor surface 50*a* of one room, such as the room 42*a*, before moving to the next room, such as the room 42*d*, to clean the surface of the room 42*d*. Different rooms can have different types of floor surfaces. For example, the room 42*e* (which can be a kitchen) can have a hard floor surface, such as wood or ceramic tile, and the room 42*a* (which can be a bedroom) can have a carpet surface, such as a medium pile carpet. Other rooms, such as the room 42*d* (which can be a dining room) can include multiple surfaces where the rug 52 is located within the room 42*d*.

During cleaning or traveling operations, the robot 100 can use data collected from various sensors and calculations (such as odometry and obstacle detection) to develop a map of the environment 40. Once the map is created, the user 60 can define rooms or zones (such as the rooms 42) within the map. The map can be presentable to the user 60 on a user interface, such as a mobile device, where the user 60 can direct or change cleaning preferences.

During operation, the robot 100 can detect surface types within each of the rooms 42, which can be stored in the robot or another device. The robot 100 can update the map (or data related thereto) such as to include or account for surface types of the floor surfaces 50*a*-50*e* of each of the respective rooms 42 of the environment. In some examples, the map can be updated to show the different surface types such as within each of the rooms 42.

In some examples, the user 60 can define a behavior control zone 54 using, for example, the methods and systems described herein. In response to the user 60 defining the behavior control zone 54, the robot 100 can move toward the behavior control zone 54 to confirm the selection. After confirmation, autonomous operation of the robot 100 can be initiated. In autonomous operation, the robot 100 can initiate a behavior in response to being in or near the behavior control zone 54. For example, the user 60 can define an area of the environment 40 that is prone to becoming dirty to be the behavior control zone 54. In response, the robot 100 can initiate a focused cleaning behavior in which the robot 100 performs a focused cleaning of a portion of the floor surface 50*d* in the behavior control zone 54.

Components of the Robot

Figure 2A:
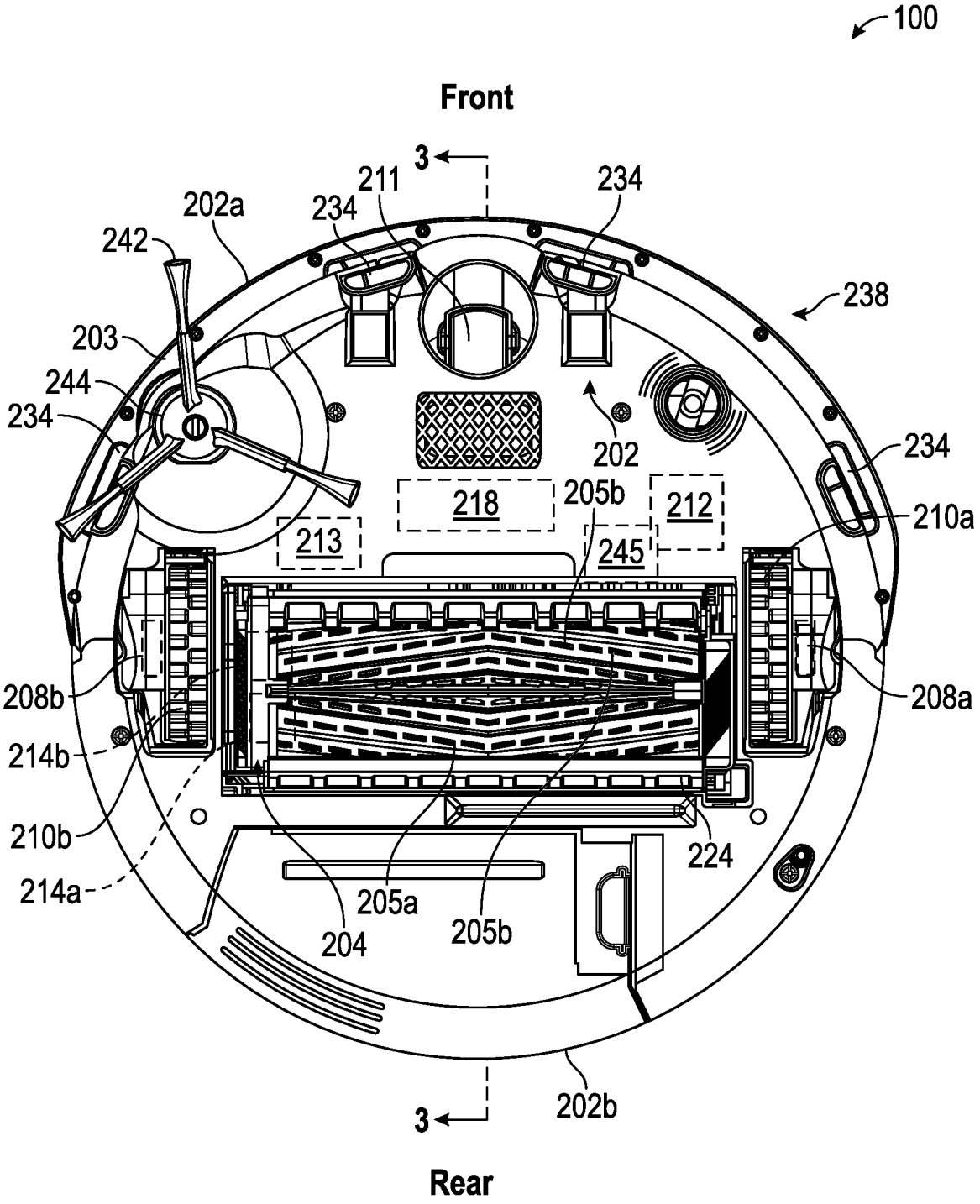
FIG. 2A illustrates a bottom view of a mobile cleaning robot.
Figure 2B:
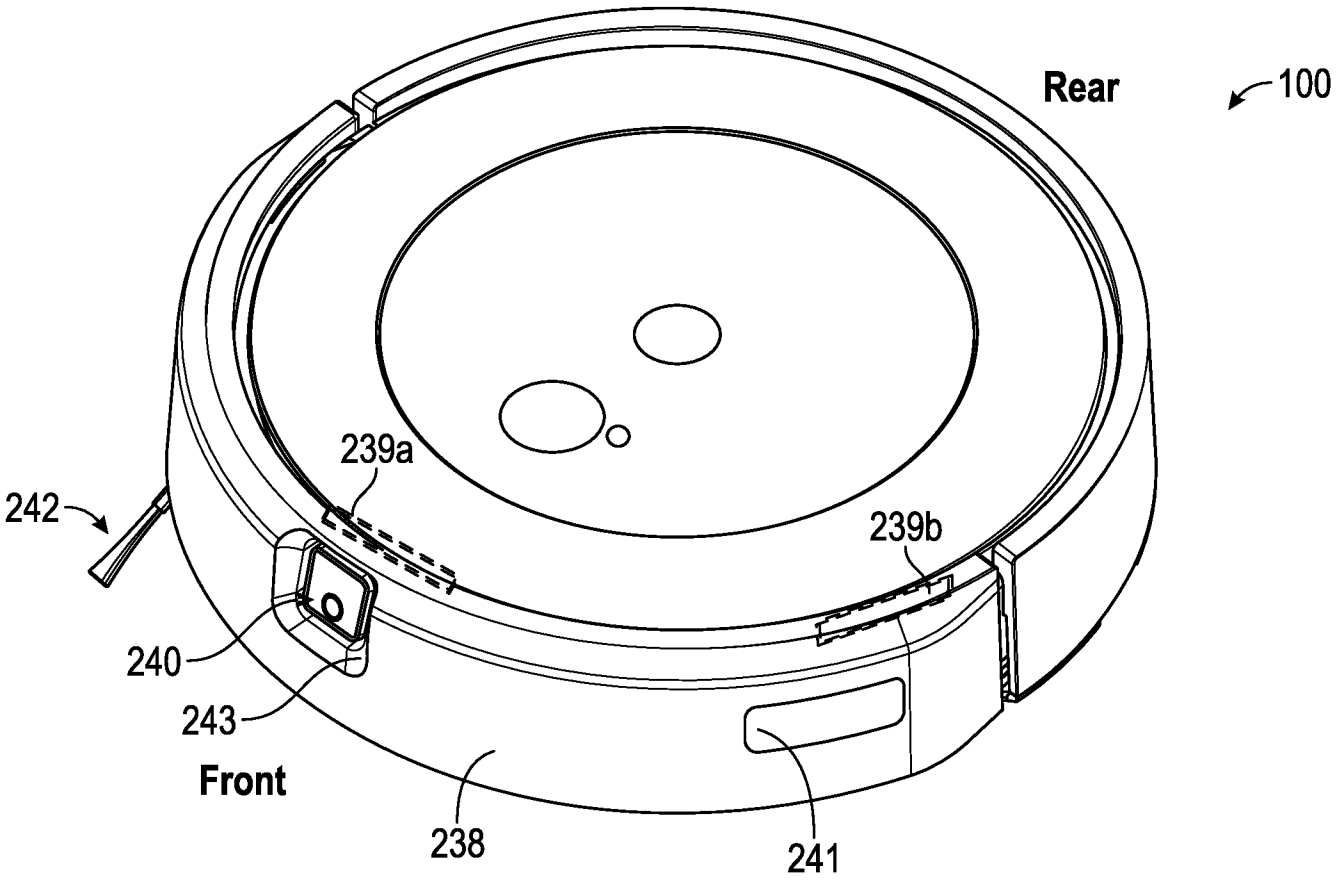
FIG. 2B illustrates an isometric view of a mobile cleaning robot.
Figure 3:
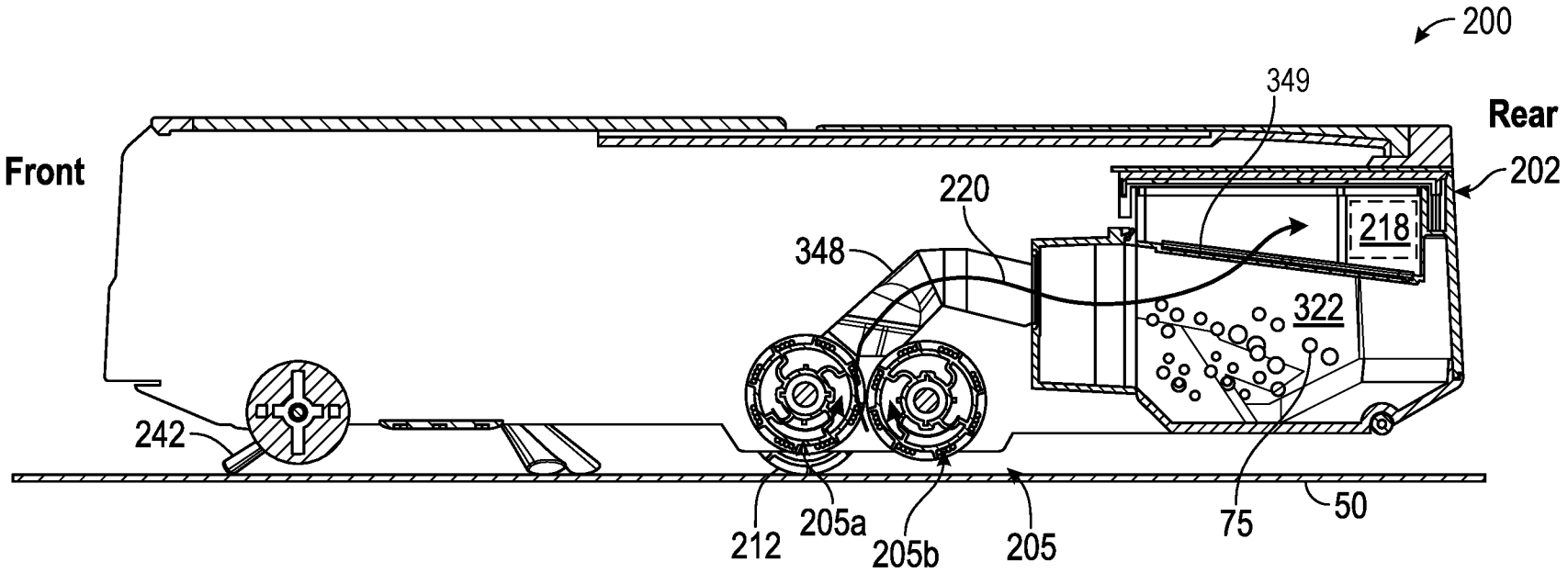
FIG. 3 illustrates a cross-section view across indicators 3-3 of FIG. 2A of a mobile cleaning robot.

FIG. 2A illustrates a bottom view of the mobile cleaning robot 100. FIG. 2B illustrates a bottom view of the mobile cleaning robot 100. FIG. 3 illustrates a cross-section view across indicators 3-3 of FIG. 2A of the mobile cleaning robot 100. FIG. 3 also shows orientation indicators Front and Rear. FIGS. 2A-3 are discussed together below.

The cleaning robot 100 can be an autonomous cleaning robot that can autonomously traverse the floor surface 50 while ingesting the debris 75 from different parts of the floor surface 50. As shown in FIGS. 2A and 3, the robot 100 can include a body 202 movable across the floor surface 50. The body 202 can include multiple connected structures to which movable components of the cleaning robot 100 are mounted. The connected structures can include, for example, an outer housing to cover internal components of the cleaning robot 100, a chassis or frame to which the drive wheels 210*a* and 210*b* and the cleaning rollers 205*a* and 205*b* (of a cleaning assembly 204) are mounted, and a bumper 238. The bumper 238 can be removably secured to the body 202 and can be movable relative to 202 while mounted thereto. In some examples, the bumper 238 form part of the body 202.

As shown in FIG. 2A, the body 202 includes a front portion 202*a* that has a substantially semicircular shape and a rear portion 202*b* that has a substantially semicircular shape. These portions can have other shapes in other examples. As shown in FIG. 2A, the robot 100 can include a drive system including actuators 208*a* and 208*b*, which can be, for example, motors. The actuators 208*a* and 208*b* can be mounted in the body 202 and can be operably connected to the drive wheels 210*a* and 210*b*, which can be rotatably mounted to the body 202 to support the body 202 above the floor surface 50. The actuators 208*a* and 208*b*, when driven, can rotate the drive wheels 210*a* and 210*b* to enable the robot 100 to autonomously move across the floor surface 50.

The controller (or processor) 212 can be located within the housing and can be a programmable controller, such as a single or multi-board computer, a direct digital controller (DDC), a programmable logic controller (PLC), or the like. In other examples the controller 212 can be any computing device, such as a handheld computer, for example, a smart phone, a tablet, a laptop, a desktop computer, or any other computing device including a processor, memory, and communication capabilities. The memory 213 can be one or more types of memory, such as volatile or non-volatile memory, read-only memory (ROM), random-access memory (RAM), magnetic disk storage media, optical storage media, flash-memory devices, and other storage devices and media. The memory 213 can be located within the body 200, connected to the controller 212 and accessible by the controller 212.

The controller 212 can operate the actuators 208*a* and 208*b* to autonomously navigate the robot 100 about the floor surface 50 during a cleaning operation. The actuators 208*a* and 208*b* can be operable to drive the robot 100 in a forward drive direction, in a backwards direction, or to turn the robot 100. The robot 100 can include a caster wheel 211 that can support the body 202 above the floor surface 50. The caster wheel 211 can support the front portion 202*a* of the body 202 above the floor surface 50, and the drive wheels 210*a* and 210*b* can support the rear portion 202*b* of the body 202 above the floor surface 50.

As shown in FIG. 3, a vacuum assembly 218 can be located at least partially within the body 202 of the robot 100, e.g., in the rear portion 202*b* of the body 202. The controller 212 can operate the vacuum assembly 218 to generate an airflow that flows through the air gap near the cleaning rollers 205, through the body 202, and out of the body 202. The vacuum assembly 218 can include, for example, an impeller that generates the airflow when rotated. The airflow and the cleaning rollers 205, when rotated, can cooperate to ingest debris 75 into a suction duct 348 of the robot 100. The suction duct 348 can extend down to or near a bottom portion of the body 202 and can be at least partially defined by the cleaning assembly 204.

The suction duct 348 can be connected to the cleaning head 204 or cleaning assembly and can be connected to a cleaning bin 322. The cleaning bin 322 can be mounted in the body 202 and can contain the debris 75 ingested by the robot 100. A filter 349 can be located in the body 202, which can help to separate the debris 75 from the airflow before the airflow 220 enters the vacuum assembly 218 and is exhausted out of the body 202. In this regard, the debris 75 can be captured in both the cleaning bin 322 and the filter before the airflow 220 is exhausted from the body 202.

The cleaning rollers 205*a* and 205*b* can operably connected to one or more actuators 214*a* and 214*b*, e.g., motors, respectively. The cleaning head 204 and the cleaning rollers 205*a* and 205*b* can be positioned forward of the cleaning bin 322. The cleaning rollers 205*a* and 205*b* can be mounted to a housing 224 of the cleaning head 204 and mounted, e.g., indirectly or directly, to the body 202 of the robot 100. In particular, the cleaning rollers 205*a* and 205*b* can be mounted to an underside of the body 202 so that the cleaning rollers 205*a* and 205*b* engage debris 75 on the floor surface 50 during the cleaning operation when the underside faces the floor surface 50.

The housing 224 of the cleaning head 204 can be mounted to the body 202 of the robot 100. In this regard, the cleaning rollers 205*a* and 205*b* can also be mounted to the body 202 of the robot 100, such as indirectly mounted to the body 202 through the housing 224. Alternatively, or additionally, the cleaning head 204 can be a removable assembly of the robot 100 where the housing 224 (with the cleaning rollers 205*a* and 205*b* mounted therein) is removably mounted to the body 202 of the robot 100.

A side brush 242 can be connected to an underside of the robot 100 and can be connected to a motor 244 operable to rotate the side brush 242 with respect to the body 202 of the robot 100. The side brush 242 can be configured to engage debris to move the debris toward the cleaning assembly 205 or away from edges of the environment 40. The motor 244 configured to drive the side brush 242 can be in communication with the controller 212. The brush 242 can be a side brush laterally offset from a center of the robot 100 such that the brush 242 can extend beyond an outer perimeter of the body 202 of the robot 100. Similarly, the brush 242 can also be forwardly offset of a center of the robot 100 such that the brush 242 also extends beyond the bumper 238 or an outer periphery of the body 202.

The robot 100 can further include a sensor system with one or more electrical sensors. The sensor system can generate one or more signals indicative of a current location of the robot 100, and can generate one or more signals indicative of locations of the robot 100 as the robot 100 travels along the floor surface 50.

For example, cliff sensors 234 (shown in FIG. 2A) can be located along a bottom portion of the body 200. The cliff sensors 234 can include an optical sensor that can be configured to detect a presence or absence of an object below the optical sensor, such as the floor surface 50. The cliff sensors 234 can be connected to the controller 212.

The bump sensors 239*a* and 239*b* (the bump sensors 239) can be connected to the body 202 and can be engageable or configured to interact with the bumper 238. The bump sensors 239 can include break beam sensors, Hall Effect sensors, capacitive sensors, switches, or other sensors that can detect contact between the robot 100 (e.g., the bumper 238) and objects in the environment 40. The bump sensors 239 can be in communication with the controller 212.

An image capture device 240 can be connected to the body 202 and can extend at least partially through the bumper 238 of the robot 100, such as through an opening 243 of the bumper 238. The image capture device 240 can be a camera, such as a front-facing camera, configured to generate a signal based on imagery of the environment 40 of the robot 100. The image capture device 240 can transmit the image capture signal to the controller 212 for use for navigation and cleaning routines.

Obstacle following sensors 241 (shown in FIG. 2B) can include an optical sensor facing outward or downward from the bumper 238 that can be configured to detect the presence or the absence of an object adjacent to a side of the body 202. The obstacle following sensor 241 can emit an optical beam horizontally in a direction perpendicular (or nearly perpendicular) to the forward drive direction of the robot 100. The optical emitter can emit an optical beam outward from the robot 100, e.g., outward in a horizontal direction, and the optical detector detects a reflection of the optical beam that reflects off an object near the robot 100. The robot 100, e.g., using the controller 212, can determine a time of flight of the optical beam and thereby determine a distance between the optical detector and the object, and hence a distance between the robot 100 and the object.

The robot 100 can also optionally include one or more dirt sensors 245 connected to the body 202 and in communication with the controller 212. The dirt sensors 245 can be a microphone, piezoelectric sensor, optical sensor, or the like, and can be located in or near a flow path of debris, such as near an opening of the cleaning rollers 205 or in one or more ducts within the body 202. This can allow the dirt sensor(s) 245 to detect how much dirt is being ingested by the vacuum assembly 218 (e.g., via the extractor 204) at any time during a cleaning mission. Because the robot 100 can be aware of its location, the robot 100 can keep a log or record of which areas or rooms of the map are dirtier or where more dirt is collected. This information can be used in several ways, as discussed further below.

Operation of the Robot

In operation of some examples, the robot 100 can be propelled in a forward drive direction or a rearward drive direction. The robot 100 can also be propelled such that the robot 100 turns in place or turns while moving in the forward drive direction or the rearward drive direction.

When the controller 212 causes the robot 100 to perform a mission, the controller 212 can operate the motors 208 to drive the drive wheels 210 and propel the robot 100 along the floor surface 50. In addition, the controller 212 can operate the motors 214 to cause the rollers 205*a* and 205*b* to rotate, can operate the motor 244 to cause the brush 242 to rotate, or can operate the motor of the vacuum system 218 to generate airflow. The controller 212 can also execute software stored on the memory 213 to cause the robot 100 to perform various navigational and cleaning behaviors by operating the various motors or components of the robot 100.

The various sensors of the robot 100 can be used to help the robot navigate and clean within the environment 40. For example, the cliff sensors 234 can detect obstacles such as drop-offs and cliffs below portions of the robot 100 where the cliff sensors 234 are disposed. The cliff sensors 234 can transmit signals to the controller 212 so that the controller 212 can redirect the robot 100 based on signals from the cliff sensors 234.

In some examples, a bump sensor 239*a* can be used to detect movement of the bumper 238 in one or more directions of the robot 100. For example, a bump sensor 239*b* can be used to detect movement of the bumper 238 from front to rear or along one or more sides of the robot 100. The bump sensors 239 can transmit signals to the controller 212 so that the controller 212 can redirect the robot 100 based on signals from the bump sensors 239.

In some examples, the obstacle following sensors 241 can detect detectable objects, including obstacles such as furniture, walls, persons, and other objects in the environment of the robot 100. In some implementations, the sensor system can include an obstacle following sensor along a side surface, and the obstacle following sensor can detect the presence or the absence an object adjacent to the side surface. The one or more obstacle following sensors 241 can also serve as obstacle detection sensors, similar to proximity sensors.

The robot 100 can also include sensors for tracking a distance travelled by the robot 100. For example, the sensor system can include encoders associated with the motors 208 for the drive wheels 210, and the encoders can track a distance that the robot 100 has travelled. In some implementations, the sensor can include an optical sensor facing downward toward a floor surface. The optical sensor can be positioned to direct light through a bottom surface of the robot 100 toward the floor surface 50. The optical sensor can detect reflections of the light and can detect a distance travelled by the robot 100 based on changes in floor features as the robot 100 travels along the floor surface 50.

The image capture device 240 can be configured to generate a signal based on imagery of the environment 40 of the robot 100 as the robot 100 moves about the floor surface 50. The image capture device 240 can transmit such a signal to the controller 212. The image capture device 240 can capture images of wall surfaces of the environment so that features corresponding to objects on the wall surfaces can be used for localization.

The controller 212 can use data collected by the sensors of the sensor system to control navigational behaviors of the robot 100 during the mission. For example, the controller 212 can use the sensor data collected by obstacle detection sensors of the robot 100 (e.g., the cliff sensors 234, the bump sensors 239, and the image capture device 240) to help the robot 100 avoid obstacles when moving within the environment of the robot 100 during a mission.

The sensor data can also be used by the controller 212 for simultaneous localization and mapping (SLAM) techniques in which the controller 212 extracts or interprets features of the environment represented by the sensor data and constructs a map of the floor surface 50 of the environment. The sensor data collected by the image capture device 240 can be used for techniques such as vision-based SLAM (VSLAM) in which the controller 212 can extract visual features corresponding to objects in the environment 40 and can construct the map using these visual features. As the controller 212 directs the robot 100 about the floor surface 50 during the mission, the controller 212 can use SLAM techniques to determine a location of the robot 100 within the map by detecting features represented in collected sensor data and comparing the features to previously stored features. The map formed from the sensor data can indicate locations of traversable and non-traversable space within the environment. For example, locations of obstacles can be indicated on the map as non-traversable space, and locations of open floor space can be indicated on the map as traversable space.

The sensor data collected by any of the sensors can be stored in the memory 213. In addition, other data generated for the SLAM techniques, including mapping data forming the map, can be stored in the memory 213. These data produced during the mission can include persistent data that are produced during the mission and that are usable during further missions. In addition to storing the software for causing the robot 100 to perform its behaviors, the memory 213 can store data resulting from processing of the sensor data for access by the controller 212. For example, the map can be a map that is usable and updateable by the controller 212 of the robot 100 from one mission to another mission to navigate the robot 100 about the floor surface 50.

The persistent data, including the persistent map, helps to enable the robot 100 to efficiently clean the floor surface 50. For example, the map enables the controller 212 to direct the robot 100 toward open floor space and to avoid non-traversable space. In addition, for subsequent missions, the controller 212 can use the map to optimize paths taken during the missions to help plan navigation of the robot 100 through the environment 40.

Docking Station Example

Figure 4:
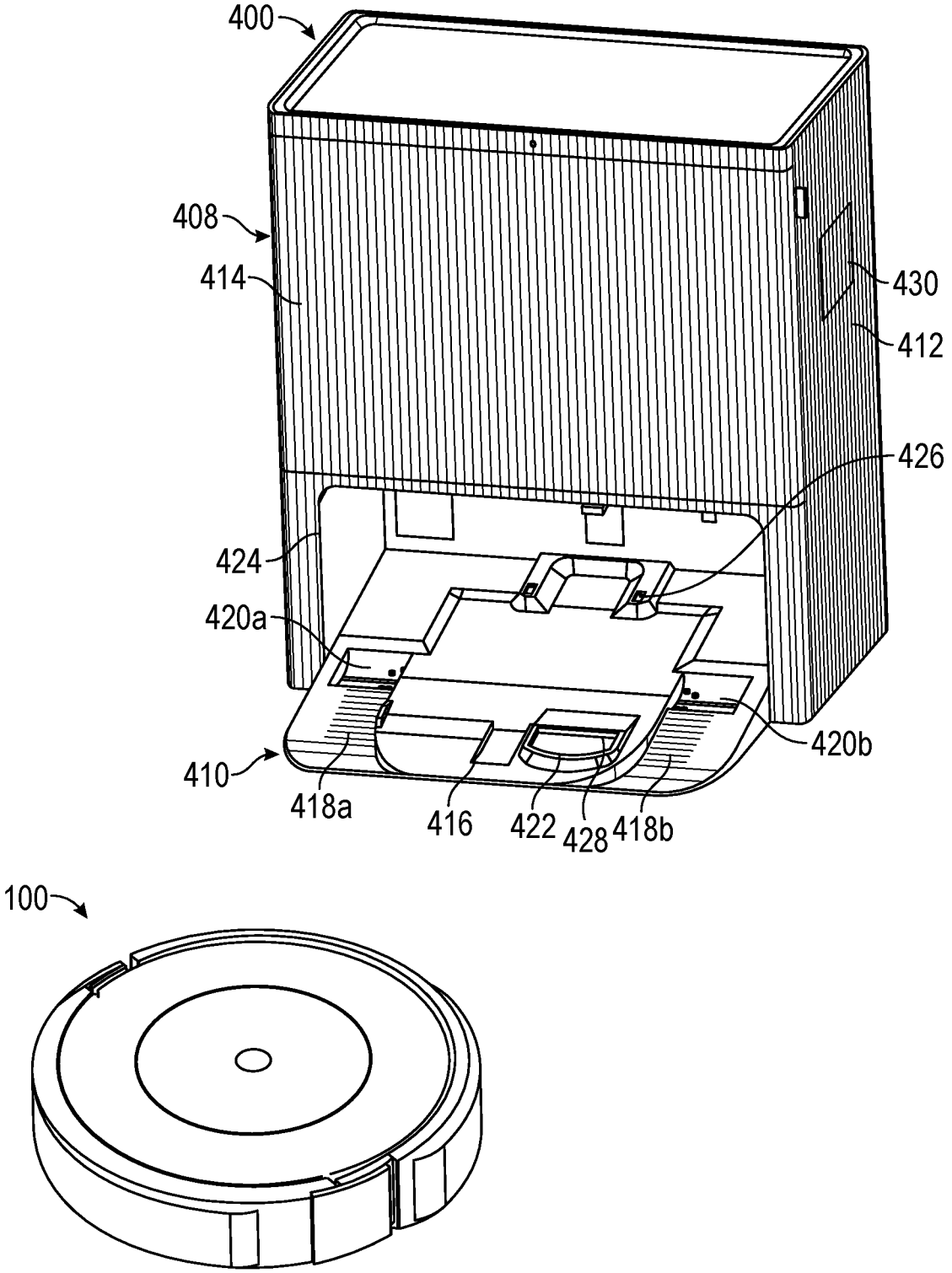
FIG. 4 illustrates an isometric view of a docking station and a mobile cleaning robot.

FIG. 4 illustrates an isometric view of a docking station 100 for a mobile cleaning robot 100. The mobile cleaning robot can be a vacuuming robot, a mopping robot, or a combination thereof (two-in-one) mobile cleaning robot configured to perform mopping and cleaning operations in an environment.

The docking station 400 can include a canister 408 and a base 410. The canister 408 can include an outer wall 412 and a door 414 and the canister 408 can be connected to the base 410. The base 410 can include a platform 416 including tracks 418*a* and 418*b* including respective wheel wells 420*a* and 420*b*. The platform 416 can also include a vacuum port 422.

The components of the docking station 400 can be rigid or semi-rigid components made of materials such as one or more of metals, plastics, foams, elastomers, ceramics, composites, combinations thereof, or the like. Materials of some components are discussed in further detail below. The mobile robot 100 can be a mobile cleaning robot including wheels, extractor, a debris bin, a controller, and various sensors, and can be consistent with the robot 100 described above. The robot 100 can be configured to perform autonomous cleaning missions or routines within an environment.

The base 410 can be a ramped member including the platform 416 and the tracks 418*a* and 418*b*, where the base 410 can be configured to receive the mobile cleaning robot 100 thereon for maintenance, such as charging and emptying debris from the mobile cleaning robot. The tracks 418 can be configured to receive wheels of the robot 100 to guide the robot 100 onto the base 410 for charging and debris evacuation using contacts 426. The contacts 426 can be (or can be part of) an electrical power interface configured to provide electrical power to the mobile cleaning robot 100. The platform 416 and the tracks 418 can be sloped toward the front portion to help allow the mobile robot 100 to dock on the station 400.

The docking station 400 can also include a docking port 424 configured to at least partially receive the mobile cleaning robot 100 therein. When the robot 100 is positioned on the base 410, such as when wheels of the robot 100 are in wheel wells 420, the vacuum port 422 can be aligned with a vacuum outlet of the robot 100. The vacuum port 422 can extend through the base 410 and can connect to the vacuum inlet of the canister 408. The vacuum port 422 can be connected to a debris duct 428 that can extend through the base 410 and into the canister 408 such as to carry debris into a debris bin.

For example, the mobile cleaning robot 100 can move into the docking port 424 by traversing over the tracks 418*a* and 418*b* until drive wheels of the mobile cleaning robot 402 rest in the wheel wells 420, which can align the vacuum port 422 with a debris port of the robot and can align charging contacts 426 of the dock with contacts of the mobile cleaning robot 402, along with other features of the mobile cleaning robot 100 and the docking station 400.

The canister 408 can be an upper portion of the docking station 400 connected to a rear portion of the base 410 and can extend upward therefrom, such that the canister 408 can be located at least partially above the base 410. The outer wall 412 of the canister 408 can have a shape of a substantially rectangular hollow prism with rounded corners where the outer wall 412 can define a front portion of the canister 408 that is open. The outer wall 112 can at least partially enclose the debris bin and a fan compartment.

The door 414 can be connected to the outer wall 412 (such as by hinges or other fasteners), such as at a side portion of the door 414. The door 414 can be releasably securable to the outer wall 412, such as at a side portion of the door 414 and the outer wall 412 (such as via a friction/interference fit, latch, or the like). Removal of the door 414 or opening of the door 414 (e.g., from a front portion of the canister 408) can provide access to a debris bin, a debris collector 430, or a fan compartment.

As discussed in further detail below, the docking station 400 can include the debris collector 430 connected to the debris duct 428 upstream of a debris bin, the debris collector 430 can be configured to collect debris from a debris airstream of the debris duct 428. As shown in FIG. 4, the debris collector 430 can be user-accessible through a side wall 432 of the outer wall 412 of the canister 408, allowing a user to retrieve items ingested by the robot 100 and evacuated into the debris collector 430, helping to prevent unwanted disposal of items. Optionally, a portion of the debris collector 430 can be transparent, allowing a user to view items therein from outside the docking station 400.

Network Examples

Figure 5:
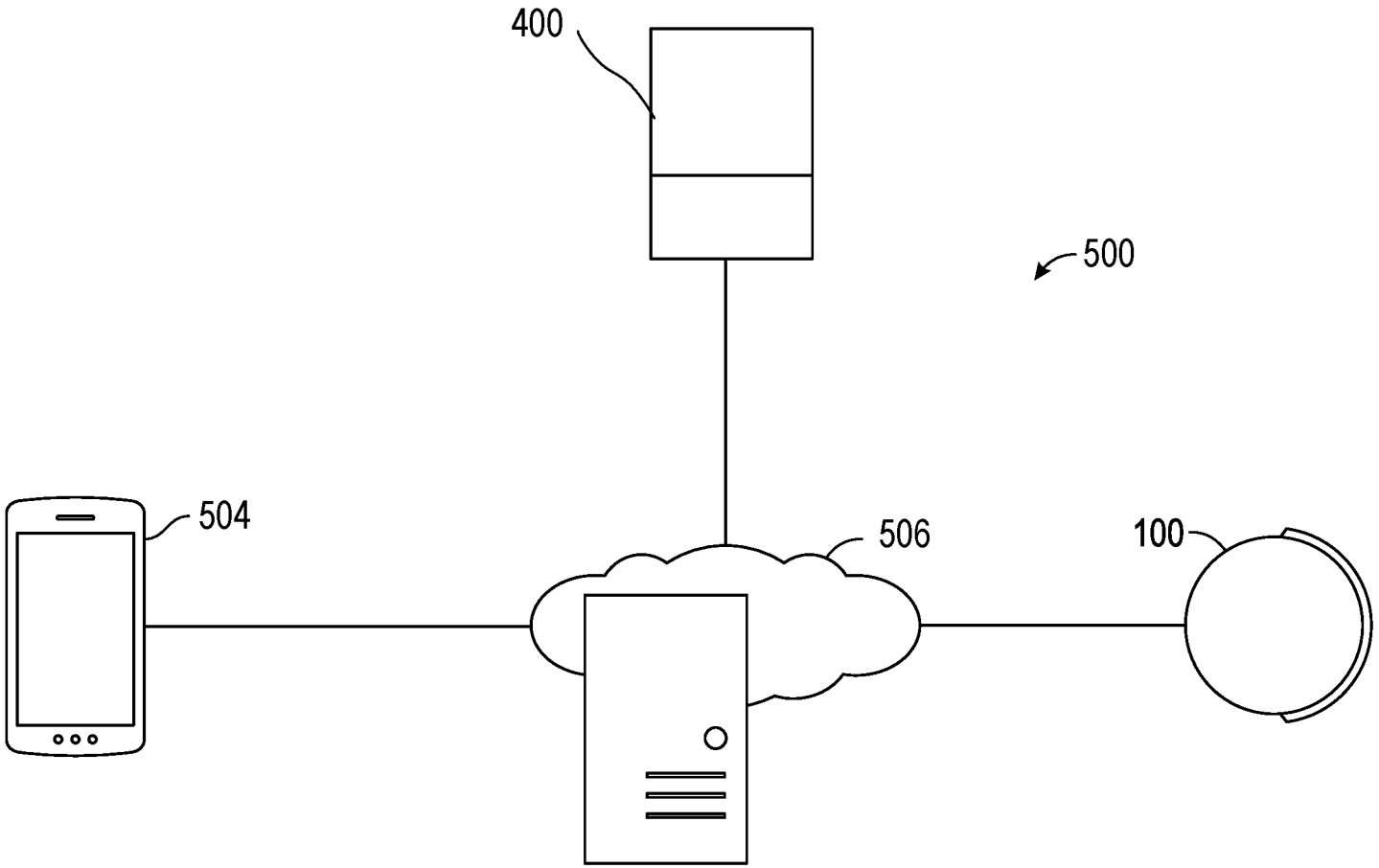
FIG. 5 illustrates a diagram illustrating an example of a communication network in which a mobile cleaning robot operates and data transmission in the network.

FIG. 5 is a diagram illustrating by way of example and not limitation a communication network 500 that enables networking between the mobile robot 100 and one or more other devices, such as a mobile device 504, a cloud computing system 506, or the docking station 400. Using the communication network 510, the robot 100, the mobile device 504, the docking station 400, and the cloud computing system 506 can communicate with one another to transmit and receive data from one another. In some examples, the robot 100, the docking station 400, or both the robot 100 and the docking station 400 communicate with the mobile device 504 through the cloud computing system 506. Alternatively, or additionally, the robot 100, the docking station 400, or both the robot 100 and the docking station 400 communicate directly with the mobile device 504. Various types and combinations of wireless networks (e.g., Bluetooth, radio frequency, optical based, etc.) and network architectures (e.g., mesh networks) can be employed by the communication network 510.

In some examples, the mobile device 504 can be a remote device that can be linked to the cloud computing system 506 and can enable a user to provide inputs. The mobile device 504 can include user input elements such as, for example, one or more of a touchscreen display, buttons, a microphone, a mouse, a keyboard, or other devices that respond to inputs provided by the user. The mobile device 504 can also include immersive media (e.g., virtual reality) with which the user can interact to provide input. The mobile device 504, in these examples, can be a virtual reality headset or a head-mounted display.

The user can provide inputs corresponding to commands for the mobile robot 100. In such cases, the mobile device 504 can transmit a signal to the cloud computing system 506 to cause the cloud computing system 506 to transmit a command signal to the mobile robot 100. In some implementations, the mobile device 504 can present augmented reality images. In some implementations, the mobile device 504 can be a smart phone, a laptop computer, a tablet computing device, or other mobile device.

According to some examples discussed herein, the mobile device 504 can include a user interface configured to display a map of the robot environment. A robot path, such as that identified by a coverage planner, can also be displayed on the map. The interface can receive a user instruction to modify the environment map, such as by adding, removing, or otherwise modifying a keep-out zone in the environment; adding, removing, or otherwise modifying a focused cleaning zone in the environment (such as an area that requires repeated cleaning); restricting a robot traversal direction or traversal pattern in a portion of the environment; or adding or changing a cleaning rank, among others.

In some examples, the communication network 510 can include additional nodes. For example, nodes of the communication network 510 can include additional robots. Also, nodes of the communication network 510 can include network-connected devices that can generate information about the environment 40. Such a network-connected device can include one or more sensors, such as an acoustic sensor, an image capture system, or other sensor generating signals, to detect characteristics of the environment 40 from which features can be extracted. Network-connected devices can also include home cameras, smart sensors, or the like.

In the communication network 510, the wireless links can utilize various communication schemes, protocols, etc., such as, for example, Bluetooth classes, Wi-Fi, Bluetooth-low-energy, also known as BLE, 802.15.4, Worldwide Interoperability for Microwave Access (WiMAX), an infrared channel, satellite band, or the like. In some examples, wireless links can include any cellular network standards used to communicate among mobile devices, including, but not limited to, standards that qualify as 1G, 2G, 3G, 4G, 5G, 6G, or the like. The network standards, if utilized, qualify as, for example, one or more generations of mobile telecommunication standards by fulfilling a specification or standards such as the specifications maintained by International Telecommunication Union. For example, the 4G standards can correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards can use various channel access methods, e.g., FDMA, TDMA, CDMA, or SDMA.

Debris Separation Examples

Figure 6B:
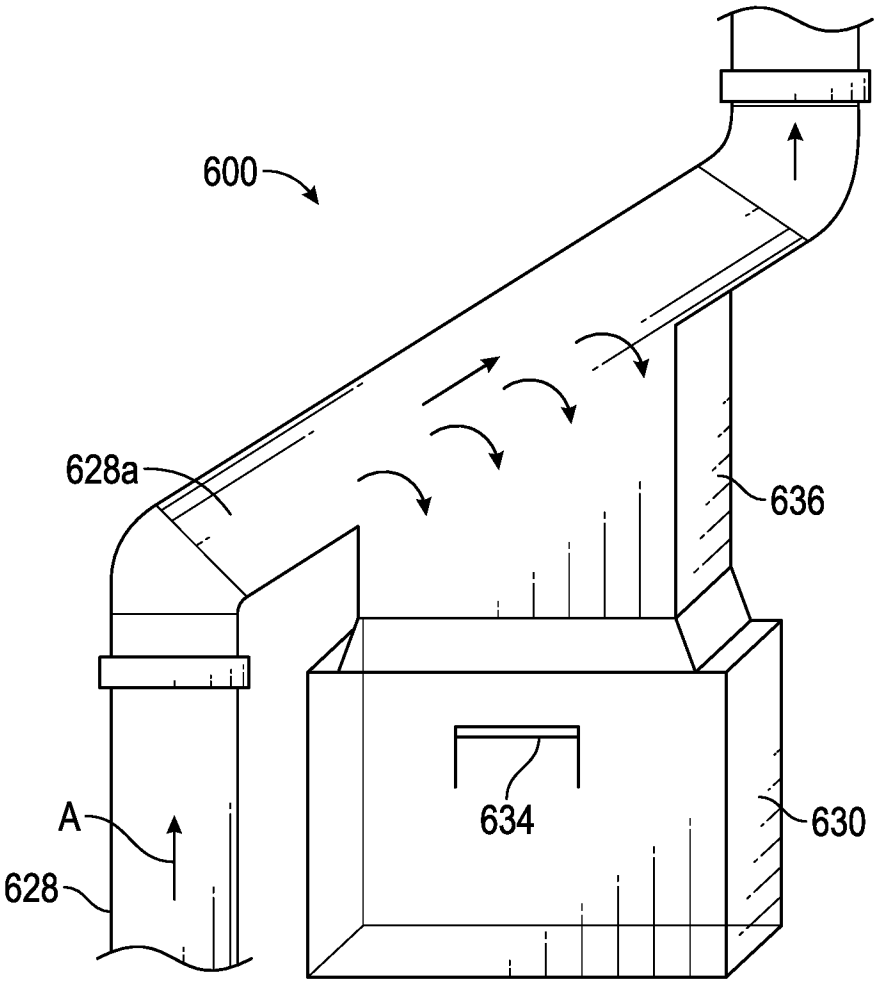
FIG. 6B illustrates a schematic view of a portion of a docking station for a mobile cleaning robot.
Figure 6A:
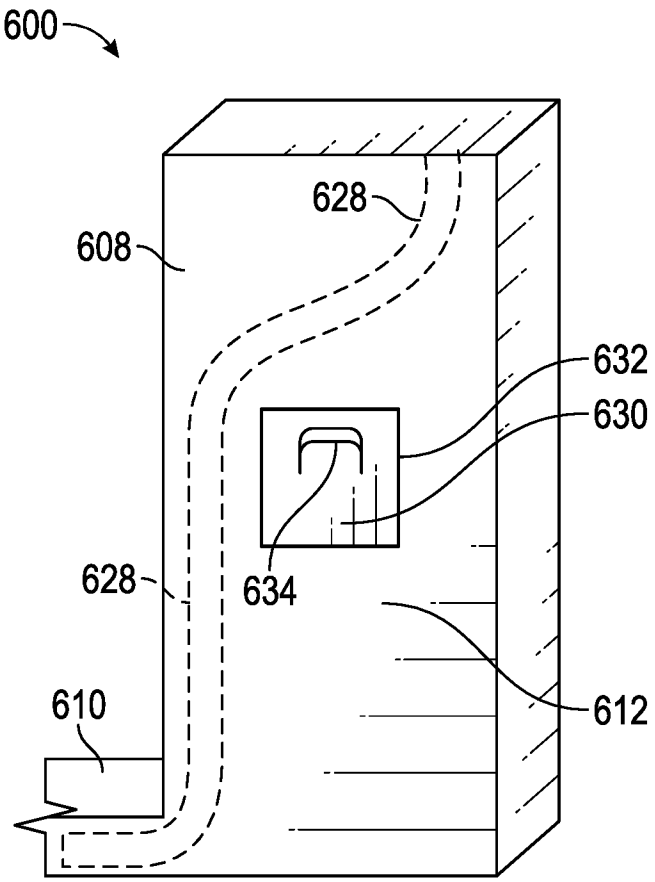
FIG. 6A illustrates a side view of a docking station for a mobile cleaning robot.

FIG. 6A illustrates a side view of a docking station 600 for a mobile cleaning robot. FIG. 6B illustrates a schematic view of a portion of the docking station 600 for a mobile cleaning robot. The docking station 600 can be similar to the docking station 400 discussed above; FIGS. 6A and 6B show additional details of a debris collector. Any of the systems discussed above or below can be modified to include the features of the docking station 600.

FIG. 6A shows that the docking station 600 can include a debris duct 628 extending from a base 610 and into a canister 608, such as to connect to a debris bin and evacuation fan (blower) downstream of a debris collector 630. As shown in FIG. 6A, the debris duct 628 can extend through the base and into the canister 608 where the debris duct 628 can connect to the debris collector 630, such as for collection of large debris from the debris duct 628 before the items are collected by the debris bin.

As also shown in FIG. 6A, the debris collector 630 can include or can define a drawer 632 extending at least partially into the canister 608 through an outer wall 612 thereof. The drawer 632 can include a handle 634 that can be user-operable to remove (or partially remove) the drawer 632 from the canister 608 such as to allow a user to collect relatively large debris items separated into or collected by the debris collector 630. The drawer 632 can optionally be translatable or slidable with respect to the outer wall 612, such as for removal of the debris collector 630. Optionally, the debris collector 630 can be connected to the outer wall 612 via a hinge and can rotate with respect to the outer wall 612. Optionally, the drawer 632 can include a transparent or translucent portion at the outer wall 612 to allow a user to view contents of the debris collector 630 when the drawer 632 is installed within the canister 608. The drawer 632 can include a seal engageable with the outer wall 612 (or another portion of the docking station 600) to form a seal between the drawer 632 and the canister 608 when the drawer 632 is inserted into the canister 608.

FIG. 6B shows the debris collector 630 connected to the debris duct 628. More specifically, FIG. 6B shows that the debris duct 628 can include a debris collection duct 636 connected to the debris duct 628 and connected to the debris collector 630. The debris collection duct 636 can be connected to the debris duct 628 at an angled portion 628*a* of the debris duct 628.

In operation, a debris airstream A can be generated by a fan or blower of the docking station 600 and can travel from the robot (e.g., the robot 100), through the base 610 via the debris duct 628 and into the canister 608. Because the angled portion 628*a* is angled with respect to a gravitational force and because the debris collection duct 636 and the debris collector 630 are located directly below an opening formed in the angled portion 628*a*, relatively heavy debris can fall out of the debris airstream A as it passes through the angled portion 628*a*. In this way, relatively large or heavy debris can collect in the debris collector 630 where it can be retrieved by a user via the drawer 632.

Figure 7:
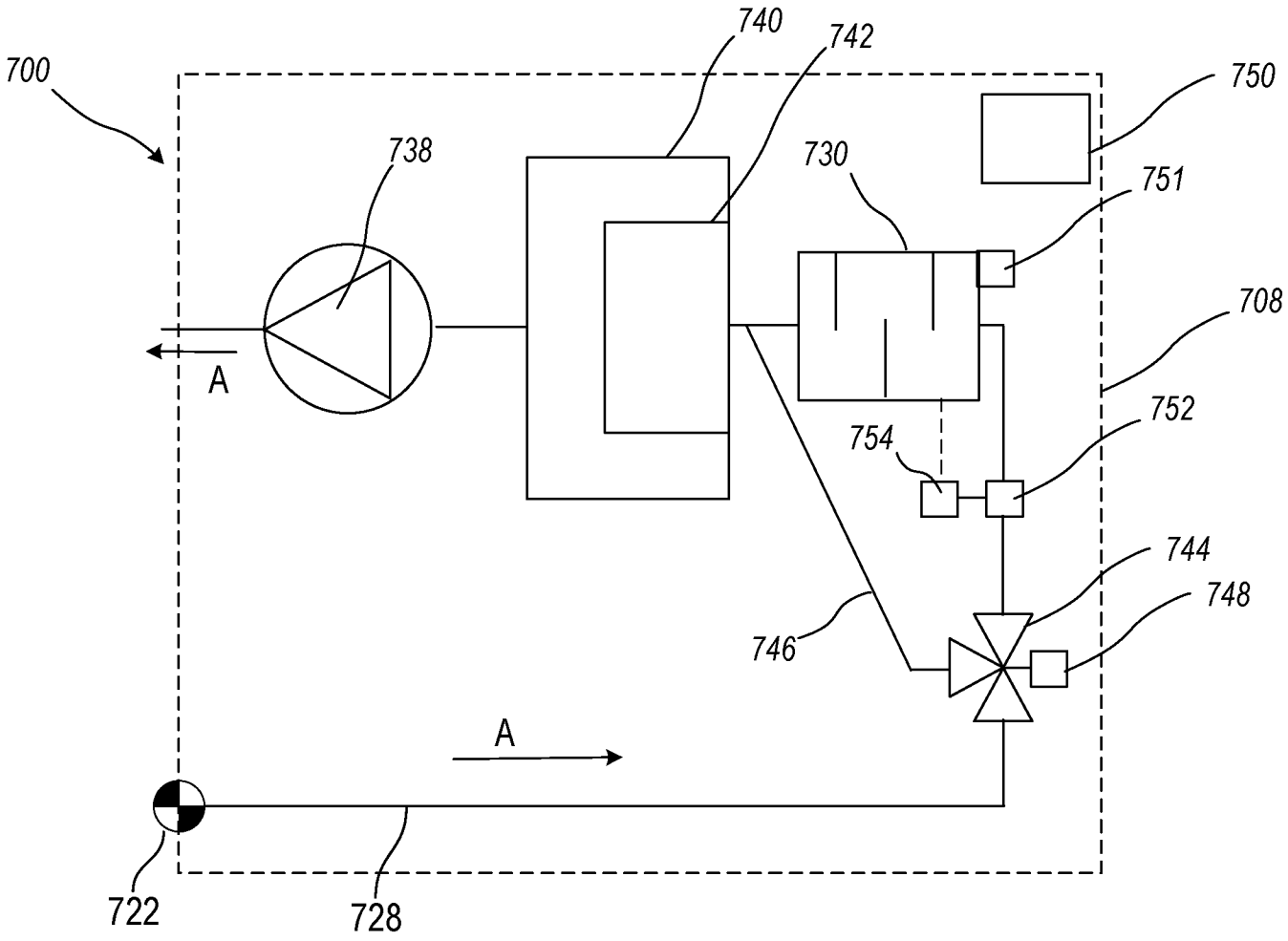
FIG. 7 illustrates a schematic view of a portion docking station for a mobile cleaning robot.

FIG. 7 illustrates a schematic view of a portion docking station 700 for a mobile cleaning robot. The docking station 700 can be similar to the docking stations discussed above; FIG. 7 shows how the debris collection system can be connected. Any of the systems discussed above or below can be modified to include the features of the docking station 700.

As shown in FIG. 7, a debris duct 728 can begin at an opening or port 722 in the docking station 700, such as in a base (e.g., the base 410). The duct 728 can extend through the docking station 700 and can end at a discharge downstream of a blower or debris exhaust fan 738. The debris exhaust fan 738 can include a motor and can be configured to operate to draw an air stream A from the opening 722 (out of the robot 100) and through the various components of the docking station 700 before exhausting the air stream A.

The docking station 700 can also include a debris bin 740 upstream of the blower or debris exhaust fan 738. The debris bin 740 can include a debris bag 742 that can be configured to collect debris from the airstream A before the airstream is exhausted from the docking station 700. The debris bag 742 can be user replaceable to dispose of debris collected by the robot 100 and evacuated into the docking station 700.

A debris collector 730 can be located upstream of the debris bin 740 and the debris bag 742 such that the debris collector 730 can collect large debris items from the air stream A before the items reach the debris bag 742, helping to limit unwanted items from entering the debris bag 742. The debris collector 730 can include one or more separation devices, such as a baffle, as discussed in further detail below, to help separate large or heavy debris items from the air stream A ahead of the debris bag 742.

FIG. 7 also shows that the docking station 700 can include a control device 744, such as a damper, which can be connected to the debris duct 728 upstream of the debris collector 730. Optionally, the control device 744 can be located downstream of the debris collector 730. The control device 744 can also be connected to a bypass duct 746. The bypass duct can further connect to the debris duct 728 between the debris collector 730 and the debris bin 740 such as to form a bypass flow path for the air stream A around the debris collector 730. In operation, the control device 744 can be movable between an open position and a bypass position, where, in the open position, the air stream A can be directed to the debris collector 730 and in the bypass position, the air stream A can be directed to an inlet of the debris bag 742, bypassing the debris collector 730. Optionally, the debris collector 730 or the docking station 700 can include a visual indicator to indicate to a user when the debris collector 730 is engaged (such as fully seated) or disengaged.

Optionally, the control device 744 can be configured to control an amount of flow through the debris collector 730. For example, the control device 744 can be manually or automatically adjusted to control an amount of air that flows through the bypass duct 746 and the debris collector 730, such as to adjust an amount of debris separation performed by the debris collector 730.

Optionally, the control device 744 can include an actuator 748. The actuator 748 can be an electrical device in communication with a controller 750. In such a configuration, the controller 750 can operate the actuator 748 to move the control device 744 between the open position and the bypass position. Optionally, the actuator 748 can be a manually-operated device, such as a mechanical switch, lever, or slider, and the actuator 748 can be configured to allow a user to move the control device 744 between the open position and the bypass position.

Optionally, the docking station 700 can include a control device 752 in addition to or in lieu of the control device 744. The control device 752 can be movable between an open position and a closed position, where, in the open position, the air stream A can be directed to the debris collector 730 and in the closed position, the air stream A can be directed to the bypass duct 746 and to an inlet of the debris bag 742, bypassing the debris collector 730. The control device 752 can include an actuator 754, which can be a manual actuator that is user operable or can be an electric actuator connected to the controller 750.

The actuator 754 (or the actuator 748) can be a mechanical actuator configured to control the control device 752 (or the control device 744) and can be connected to the debris collector 730. In an example where the debris collector 730 is removable, removal of the debris collector 730 from a canister 708 can cause the actuator 754 to operate the actuator 754 (or the actuator 748 to operate the control device 744) to move to a closed or bypass position, such that the air stream A bypasses the debris collector 730 when the debris collector 730 is removed from the docking station 700. In such an example, re-insertion or insertion of the debris collector 730 into the docking station 700 can cause the actuator 754 to operate the actuator 754 (or the actuator 748 to operate the control device 744) to move to an open position (or a non-bypass position).

In some examples, the controller 750 of the docking station 700 can be in communication with the robot 100 or with one or more of the components of the docking station 700, such as the blower or debris exhaust fan 738, the actuator 748, or the actuator 754. Optionally, the controller 750 can be in communication with the actuator 754 or the actuator 748 to operate the control device 752 or the control device 744, respectively, between an open position and a bypass position, such as based on one or more sensor signals from the docking station 700 or the robot 100.

For example, the robot 100 can transmit to the controller 750 a debris signal from the one or more dirt sensors 245, allowing the controller 750 to determine that large debris has been ingested by the robot 100. Alternatively, the robot 100 can determine that large debris has been ingested by the robot 100 based on the debris signal and the robot 100 can transmit such a determination to the controller 750. In either case, controller 750 can store such information and can then, upon the next evacuation of the robot 100, operate the actuator 754 or the actuator 748 to the open position, to allow the large debris to be collected by the debris collector 730.

Optionally, either the robot 100 or the controller 750 can produce an alert or transmit an alert to the mobile device 504 that a large debris item may have been ingested by the robot 100. Also, either the robot 100 or the controller 750 can produce an alert or transmit an alert to the mobile device 504 that a large debris item may have been collected from the robot 100 by the docking station 700.

The docking station 700 can include a sensor 751 connected to the debris collector 730 and optionally located at least partially within the debris collector 730. The sensor 751 can be an audio sensor (e.g., microphone or Piezoelectric) or visual sensor (e.g., camera) or load sensor (e.g., load cell). The sensor 751 can produce a signal based on activity within the debris collector 730 and can be in communication with the controller 750 such as to transmit the signal thereto. For example, the controller 750 can use the signal from the sensor 751 to determine when an item has been collected within the debris collector 730 and can transmit an alert to a user device upon such a detection. Optionally, the signal from the sensor 751 can be used to determine when the debris collector 730 is fully inserted into the canister 708. Optionally, the docking station 700 can include a separate sensor for such detection.

Figure 8:
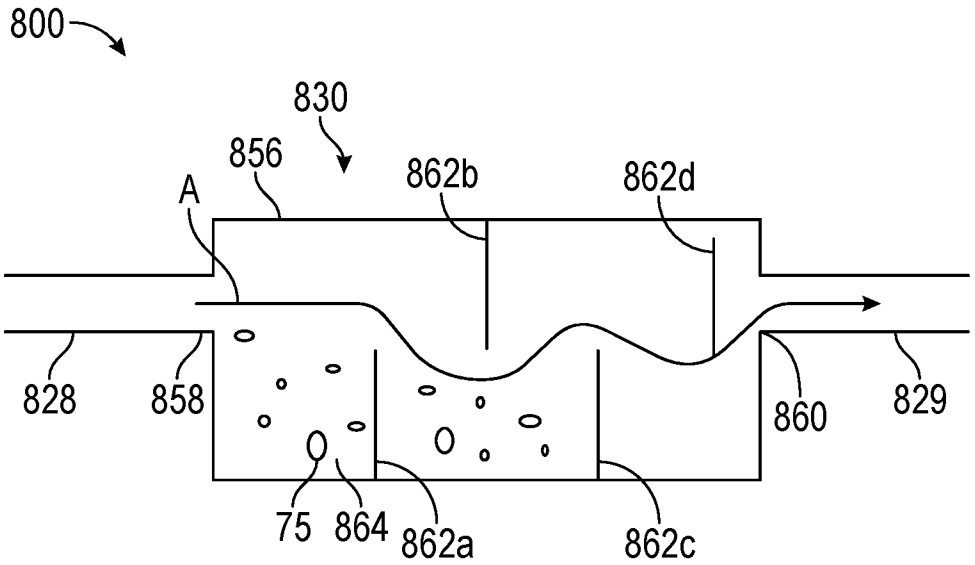
FIG. 8 illustrates a side cross-sectional view of a portion of a docking station for a mobile cleaning robot.

FIG. 8 illustrates a side cross-sectional view of a portion docking station 800 for a mobile cleaning robot. The docking station 800 can be similar to the docking stations discussed above; FIG. 8 shows an example debris collection system and how it can operate. Any of the systems discussed above or below can be modified to include the features of the docking station 800.

The portion docking station 800 can include a debris collector 830 connected to a debris duct 828 at an inlet 858 of a housing 856. The housing 856 can also connect to a discharge duct 829 at an outlet 860 of the housing 856. The housing 830 can be configured such that the air stream A flows from the debris duct 828 into the inlet 858, through the debris 830, and out the housing 856 to the discharge duct 829. From the outlet 860, the air stream can travel through the discharge duct 829 to a debris bin (e.g., the debris bin 740).

The debris collector 830 can include one or more baffles 862*a*-862*d*. The baffles 862 can be connected to one or more walls of the debris collector 830 and can be configured to interact with the air stream A, such as to cause the airstream A to follow a non-linear path (e.g., a serpentine path) through the debris collector 830. The baffles 862 can also be configured to generate Eddy currents (or at least partially recirculating air currents) to help separate debris from the air stream A. The baffles 862 can also form chambers, such as a chamber 864 formed at least in part by the baffle 862*a*. Optionally, one or more of the baffles 862 can include a hole, perforation, or plurality of holes or perforations therein or therethrough, such as to help reduce air pressure drop through the debris collector 830 while still separating large debris from the air stream A.

In operation, as the air stream A enters the inlet 858, the air stream A can enter the inlet 858 and engage the baffles 862*a*-862*c* causing large debris 75 to separate from the air stream and collect in the chambers, such as in the chamber 864. As the air stream A travels through the debris collector 830, it can engage the baffle 862*d* to further help separate large debris and to help limit large or heavy debris from leaving the debris collector 830, before discharging through the outlet 860 and entering the discharge duct 829.

Figure 9A:
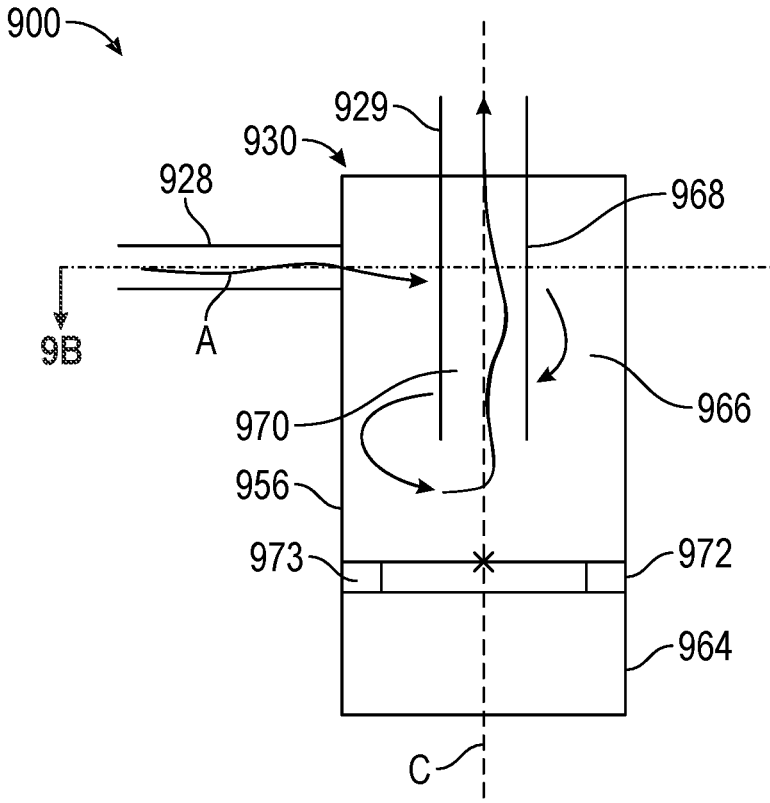
FIG. 9A illustrates a side cross-sectional view of a portion of a docking station for a mobile cleaning robot.
Figure 9B:
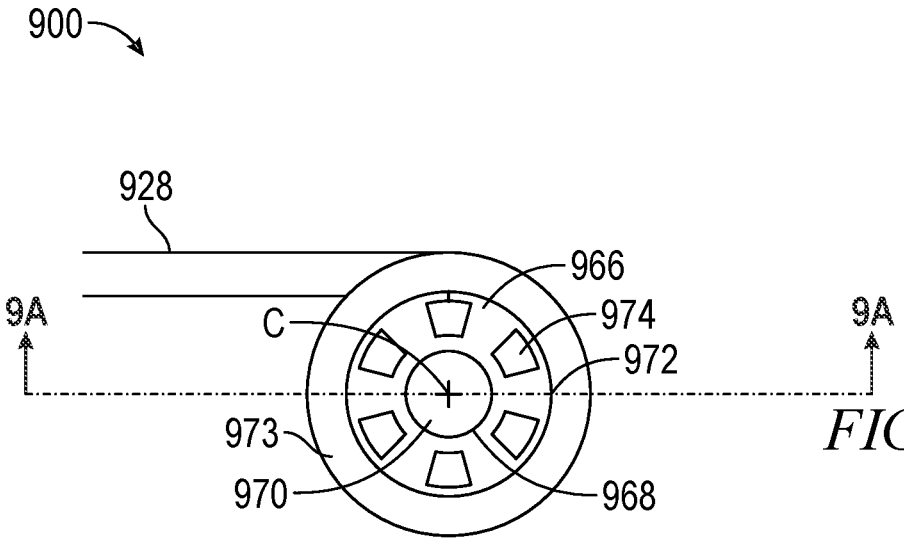
FIG. 9B illustrates a top cross-sectional view of a portion of a docking station for a mobile cleaning robot.

FIG. 9A illustrates a side cross-sectional view across indicators 9A-9A of FIG. 9B of a portion docking station 900 for a mobile cleaning robot. FIG. 9B illustrates a top cross-sectional view across indicators 9B-9B of FIG. 9A of the portion docking station 900 for a mobile cleaning robot. FIGS. 9A and 9B are discussed together below. The docking station 900 can be similar to the docking stations discussed above; FIG. 9 shows an example of a cyclone debris collection system. Any of the systems discussed above or below can be modified to include the features of the docking station 900.

As shown in FIG. 9A, the docking station 900 can include a debris collector 930 connected to a debris duct 928. The debris collector 930 can include a housing 956 defining an outer portion of an outer chamber 966. The debris collector 930 can also include an outlet tube 968 located at least partially within the housing 956 and in (or near) a center of the outer chamber 966. The outlet tube 968 can at least partially define a center chamber 970 connected to a discharge duct 929. The discharge duct 929 can be connected to a debris bin and a debris bag.

As shown in FIG. 9B, the debris collector 930 can also include a separator 972 connected to the housing 956, such as transverse or orthogonally to a central axis C of the outlet tube 968. The separator 972 can be located at a bottom portion of the outer chamber 966 adjacent an inlet of the outlet tube 968. The separator 972 can define openings 974 therein or therethrough. Optionally, the separator 972 can define a ring 973. The ring 973 can be open in the middle or can define one or more openings 974. The openings 974 can be sized and shaped to allow large debris to fall into a chamber 964 such as for retrieval of the large debris from the debris collector 930. Optionally, the chamber 964 can be separable from the housing 956.

In operation, the airstream A can enter the debris duct 928 and can travel through the outer chamber 966, such as in a cyclone, around the outlet tube 968. As the airstream A passes into the outlet tube 968, large debris can be separated out and through the separator 972 and into the chamber 964, while the airstream A can pull smaller debris (such as hair and dust) into the center chamber 970 of the outlet tube 968 and to the discharge duct 929. In this way, the debris collector 930 can operate as a cyclone separator help to separate and collect relatively large debris from the airstream A.

Figure 10:
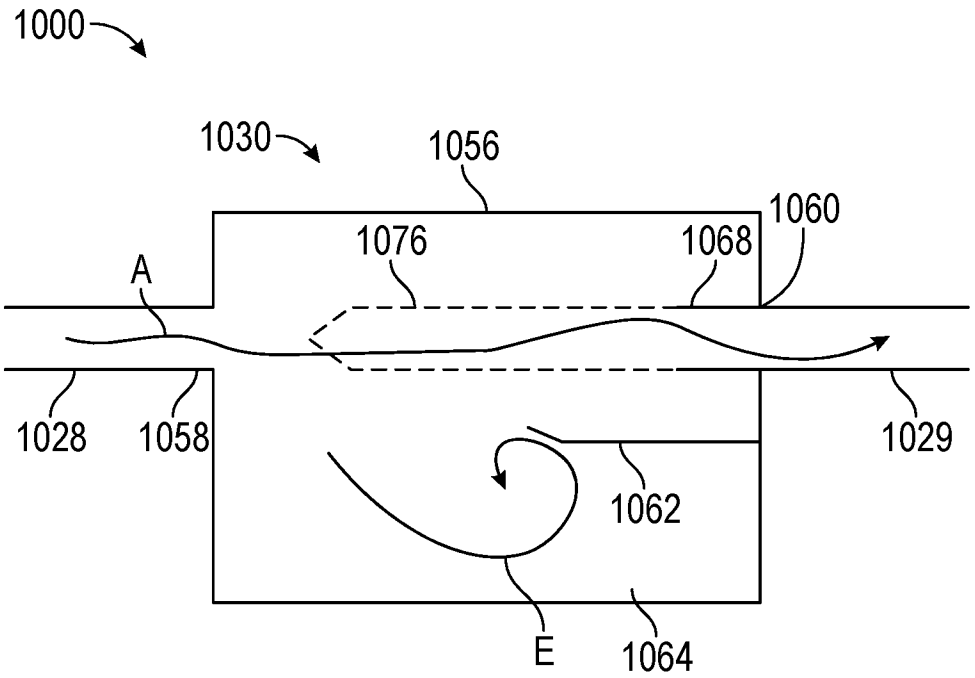
FIG. 10 illustrates a side cross-sectional view of a portion of a docking station for a mobile cleaning robot.

FIG. 10 illustrates a side cross-sectional view of a portion docking station 1000 for a mobile cleaning robot. The docking station 1000 can be similar to the docking stations discussed above; FIG. 10 shows an example debris collection system including a perforated tube. Any of the systems discussed above or below can be modified to include the features of the docking station 1000.

The docking station 1000 can include a debris collector 1030 connected to a debris duct 1028 at an inlet 1058 of a housing 1056. The housing 1056 can also connect to a discharge duct 1029 at an outlet 1060 of the housing 1056. The housing 1056 can be configured such that the air stream A flows from the debris duct 1028 into the inlet 1058, through the debris collector 1030, and out of the housing 1056 to the discharge duct 1029. From the outlet 1060, the air stream can travel through the discharge duct 1029 to a debris bin (e.g., the debris bin 740).

The debris collector 1030 can include one or more baffles 1062. The baffle 1062 can be connected to one or more walls of the debris collector 1030 and can be configured to interact with the air stream A, such as to generate an Eddy current E (or at least partially recirculating air currents) to help separate debris from the air stream A. The baffle 1062 can also form chambers, such as a chamber 1064 formed at least in part by the baffle 1062.

The debris collector 1030 can also include an outlet tube 1068 connected to the outlet 1060. The air stream A can travel from the debris duct 1028 and through the outlet tube 1068 to the outlet 1060. Optionally, the outlet tube 1068 can include a perforated portion 1076. The perforated portion 1076 can include one or more holes or bores of one size or of various sizes, such as to allow the air stream A to enter the outlet tube 1068 while limiting large debris from entering the outlet tube 1068. The quantity and size of the holes of the perforated portion 1076 can be selected or optimized to separate a debris type or size (such as large debris) or to receive a debris type or size (such as dust and hair).

Optionally, the perforated portion 1076 can be a screen or other perforated item. Optionally, the perforated portion 1076 can be removable (such as user-removable) or can be removed or eliminated.

Figure 11:
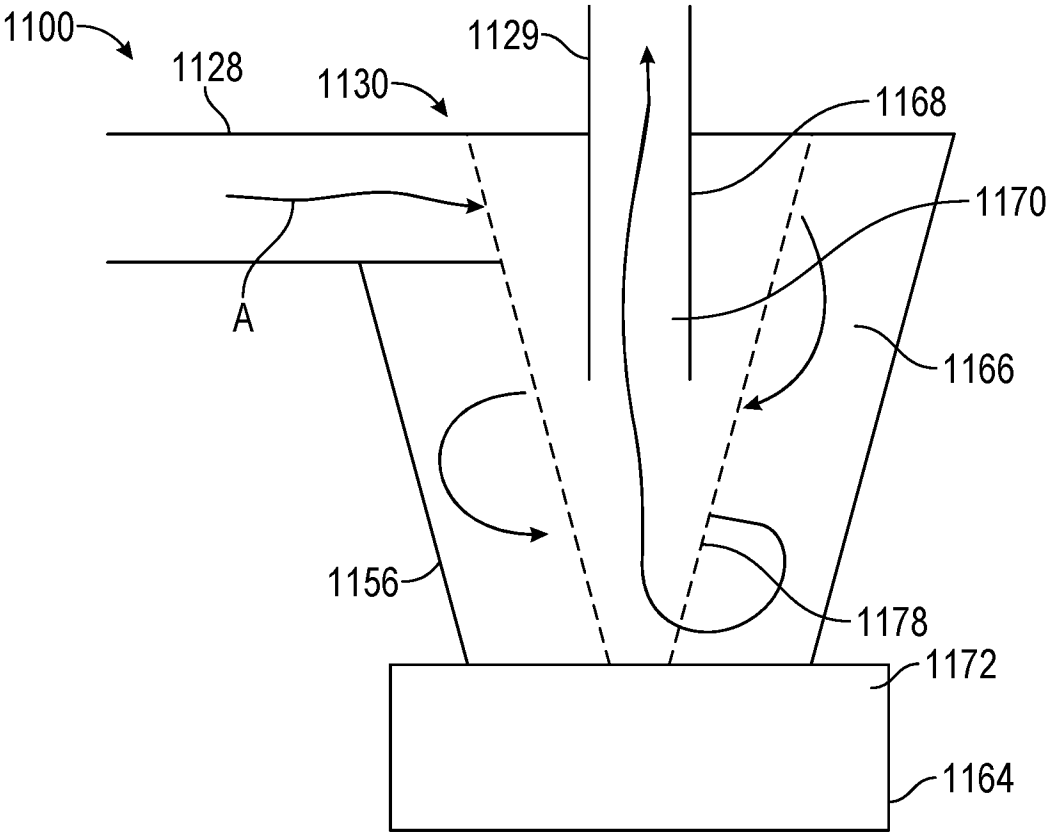
FIG. 11 illustrates a side cross-sectional view of a portion of a docking station for a mobile cleaning robot.

FIG. 11 illustrates a side cross-sectional view of a portion docking station 1100 for a mobile cleaning robot. The docking station 1100 can be similar to the docking stations discussed above; FIG. 11 shows an example cyclone debris collection system including a perforated section. Any of the systems discussed above or below can be modified to include the features of the docking station 1100.

The portion of the docking station 1100 can include a debris collector 1130 connected to a debris duct 1128. The debris collector 1130 can include a housing 1156 defining an outer portion of an outer chamber 1166. The debris collector 1130 can also include an outlet tube 1168 located at least partially within the housing 1156 and in or near a center of the outer chamber 1166. The outlet tube 1168 can at least partially define a center chamber 1170 connected to a discharge duct 1129. The discharge duct 1129 can be connected to a debris bin or a debris bag.

The debris collector 1130 can also include a separator 1172 connected to the housing 1156, such as transverse or orthogonally to an axis of the outlet tube 1168. The separator 1172 can be located at a bottom portion of the outer chamber 1166 adjacent an inlet of the outlet tube 1168. The separator 1172 can define openings therein or therethrough that can be sized and shaped to allow large debris to fall into a chamber 1164 such as for retrieval of the large debris from the debris collector 1130.

The debris collector 1130 can also include perforated portion 1178 at least partially surrounding the outlet tube 1168 and at least partially surrounding an entrance of the outlet tube 1168. The perforated portion 1178 can include one or more holes or bores of one size or of various sizes, such as to allow the air stream A to enter the outlet tube 1168 while limiting large debris from entering the outlet tube 1168. The quantity and size of the holes of the perforated portion 1178 can be selected or optimized to separate a debris type or size (such as large debris) or to receive a debris type or size (such as dust and hair). Optionally, the perforated portion 1178 can be a screen or other perforated item.

In operation, the airstream A can enter the debris duct 1128 and can travel through the outer chamber 1166, such as in a cyclone, around the outlet tube 1168 and around the perforated portion 1178. As the airstream A passes through the separator perforated portion 1178, large debris can be separated out of the air stream A and can fall to the chamber 1164, while the airstream A can pull smaller debris (such as hair and dust) into the center chamber 1170 of the outlet tube 1168 and to the discharge duct 1129. In this way, the debris collector 1130 can operate as a cyclone separator help to separate and collect relatively large debris from the airstream A.

System Example

Figure 12:
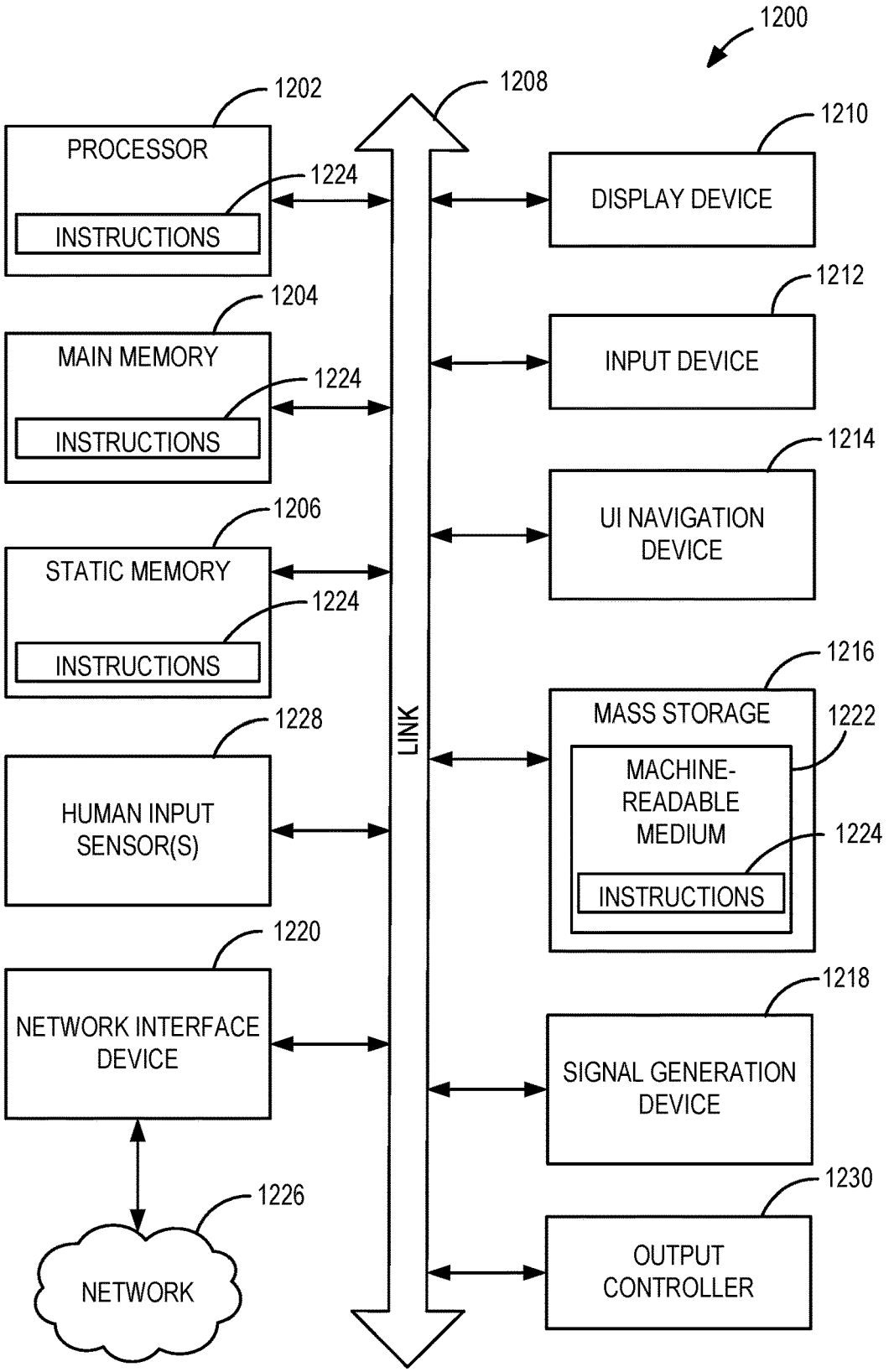
FIG. 12 illustrates a block diagram illustrating an example of a machine upon which one or more embodiments may be implemented.

FIG. 12 illustrates a block diagram of an example machine 1200 upon which any one or more of the techniques (e.g., methodologies) discussed herein may perform. Examples, as described herein, may include, or may operate by, logic or a number of components, or mechanisms in the machine 1200. Circuitry (e.g., processing circuitry) is a collection of circuits implemented in tangible entities of the machine 1200 that include hardware (e.g., simple circuits, gates, logic, etc.). Circuitry membership may be flexible over time. Circuitries include members that may, alone or in combination, perform specified operations when operating. In an example, hardware of the circuitry may be immutably designed to carry out a specific operation (e.g., hardwired). In an example, the hardware of the circuitry may include variably connected physical components (e.g., execution units, transistors, simple circuits, etc.) including a machine readable medium physically modified (e.g., magnetically, electrically, moveable placement of invariant massed particles, etc.) to encode instructions of the specific operation. In connecting the physical components, the underlying electrical properties of a hardware constituent are changed, for example, from an insulator to a conductor or vice versa. The instructions enable embedded hardware (e.g., the execution units or a loading mechanism) to create members of the circuitry in hardware via the variable connections to carry out portions of the specific operation when in operation. Accordingly, in an example, the machine readable medium elements are part of the circuitry or are communicatively coupled to the other components of the circuitry when the device is operating. In an example, any of the physical components may be used in more than one member of more than one circuitry. For example, under operation, execution units may be used in a first circuit of a first circuitry at one point in time and reused by a second circuit in the first circuitry, or by a third circuit in a second circuitry at a different time. Additional examples of these components with respect to the machine 1200 follow.

In alternative embodiments, the machine 1200 may operate as a standalone device or may be connected (e.g., networked) to other machines. In a networked deployment, the machine 1200 may operate in the capacity of a server machine, a client machine, or both in server-client network environments. In an example, the machine 1200 may act as a peer machine in peer-to-peer (P2P) (or other distributed) network environment. The machine 1200 may be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

The machine (e.g., computer system) 1200 may include a hardware processor 1202 (e.g., a central processing unit (CPU), a graphics processing unit (GPU), a hardware processor core, or any combination thereof), a main memory 1204, a static memory (e.g., memory or storage for firmware, microcode, a basic-input-output (BIOS), unified extensible firmware interface (UEFI), etc.) 1206, and mass storage 1208 (e.g., hard drive, tape drive, flash storage, or other block devices) some or all of which may communicate with each other via an interlink (e.g., bus) 1230. The machine 1200 may further include a display unit 1210, an alphanumeric input device 1212 (e.g., a keyboard), and a user interface (UI) navigation device 1214 (e.g., a mouse). In an example, the display unit 1210, input device 1212 and UI navigation device 1214 may be a touch screen display. The machine 1200 may additionally include a storage device (e.g., drive unit) 1208, a signal generation device 1218 (e.g., a speaker), a network interface device 1220, and one or more sensors 1216, such as a global positioning system (GPS) sensor, compass, accelerometer, or other sensor. The machine 1200 may include an output controller 1228, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

Registers of the processor 1202, the main memory 1204, the static memory 1206, or the mass storage 1208 may be, or include, a machine readable medium 1222 on which is stored one or more sets of data structures or instructions 1224 (e.g., software) embodying or utilized by any one or more of the techniques or functions described herein. The instructions 1224 may also reside, completely or at least partially, within any of registers of the processor 1202, the main memory 1204, the static memory 1206, or the mass storage 1208 during execution thereof by the machine 1200. In an example, one or any combination of the hardware processor 1202, the main memory 1204, the static memory 1206, or the mass storage 1208 may constitute the machine readable media 1222. While the machine readable medium 1222 is illustrated as a single medium, the term "machine readable medium" may include a single medium or multiple media (e.g., a centralized or distributed database, and/or associated caches and servers) configured to store the one or more instructions 1224.

The term "machine readable medium" may include any medium that is capable of storing, encoding, or carrying instructions for execution by the machine 1200 and that cause the machine 1200 to perform any one or more of the techniques of the present disclosure, or that is capable of storing, encoding or carrying data structures used by or associated with such instructions. Non-limiting machine readable medium examples may include solid-state memories, optical media, magnetic media, and signals (e.g., radio frequency signals, other photon based signals, sound signals, etc.). In an example, a non-transitory machine readable medium comprises a machine readable medium with a plurality of particles having invariant (e.g., rest) mass, and thus are compositions of matter. Accordingly, non-transitory machine-readable media are machine readable media that do not include transitory propagating signals. Specific examples of non-transitory machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 1224 may be further transmitted or received over a communications network 1226 using a transmission medium via the network interface device 1220 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 1220 may include one or more physical jacks (e.g., Ethernet, coaxial, or phone jacks) or one or more antennas to connect to the communications network 1226. In an example, the network interface device 1220 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 1200, and includes digital or analog communications signals or other intangible medium to facilitate communication of such software. A transmission medium is a machine readable medium.

Notes And Examples

The following, non-limiting examples, detail certain aspects of the present subject matter to solve the challenges and provide the benefits discussed herein, among others.

Example 1 is a docking station for a mobile cleaning robot, the docking station comprising: a base configured to receive at least a portion of the mobile cleaning robot thereon, the base including a debris port; and a canister connected to the base and located at least partially above the base, the canister comprising: a debris bin to receive debris from the mobile cleaning robot; a debris duct connected to the debris port and to the debris bin; and a debris collector connected to the debris duct upstream of the debris bin, the debris collector configured to collect debris from a debris airstream of the debris duct.

In Example 2, the subject matter of Example 1 optionally includes a damper connected to the debris duct upstream of the debris collector, the damper movable between an open position and a bypass position.

In Example 3, the subject matter of Example 2 optionally includes a damper actuator connected to the canister and operably connected to the damper, the damper actuator user-operable to move the damper between the open position and the bypass position.

In Example 4, the subject matter of Example 3 optionally includes a debris drawer connected to the debris collector and slidably insertable into a collection compartment of the canister between an open position and a closed position.

In Example 5, the subject matter of Example 4 optionally includes wherein removal of the debris drawer moves the actuator to the bypass position.

In Example 6, the subject matter of any one or more of Examples 2-5 optionally include a damper actuator connected to the canister and operably connected to the damper; and a controller in communication with the damper actuator, the controller configured to control the damper actuator to move the damper between an open position and a bypass position.

In Example 7, the subject matter of Example 6 optionally includes wherein the controller is configured to receive a debris signal from a debris senor of the mobile cleaning robot, the controller configured to operate the damper actuator based on the debris signal.

In Example 8, the subject matter of Example 7 optionally includes a bypass duct connected to the debris duct upstream of the damper, the bypass duct connected to the debris bin, the bypass duct configured to receive the debris airstream therethrough when the damper is in the bypass position.

In Example 9, the subject matter of any one or more of Examples 1-8 optionally include a cyclone separator located within the debris collector, the cyclone separator configured to separate debris from the debris airstream.

In Example 10, the subject matter of Example 9 optionally includes a screen connected to the cyclone separator, the screen configured to separate debris from the debris airstream.

In Example 11, the subject matter of any one or more of Examples 1-10 optionally include a screen connected to an outlet of the debris collector, the screen configured to separate debris from the debris airstream.

In Example 12, the subject matter of any one or more of Examples 1-11 optionally include a baffle located within the debris collector, the baffle configured to separate debris from the debris airstream.

In Example 13, the subject matter of Example 12 optionally includes wherein the baffle includes one or more perforations therein or therethrough.

In Example 14, the subject matter of any one or more of Examples 1-13 optionally include wherein the debris bin is configured to capture or collect dust or hair and the debris collector is configured to capture relatively large debris.

Example 15 is a docking station for a mobile cleaning robot, the docking station comprising: a base configured to receive at least a portion of the mobile cleaning robot thereon, the base including debris port; and a canister connected to the base and located at least partially above the base, the canister comprising: a debris bin to receive debris from a debris airstream from the mobile cleaning robot; and a debris collector connected to the debris bin and the debris port, the debris collector configured to collect debris from the debris airstream.

In Example 16, the subject matter of Example 15 optionally includes an evacuation fan connected to the canister and connectable to the mobile cleaning robot to evacuate debris from a debris bin of the mobile cleaning robot to a debris bag of the canister.

In Example 17, the subject matter of any one or more of Examples 15-16 optionally include a damper located upstream of the debris collector, the damper movable between an open position and a bypass position.

In Example 18, the subject matter of Example 17 optionally includes a damper actuator connected to the canister and operably connected to the damper, the damper actuator user-operable to move the damper between the open position and the bypass position.

In Example 19, the subject matter of any one or more of Examples 15-18 optionally include a debris drawer connected to the debris collector and slidably insertable into a collection compartment of the canister between an open position and a closed position.

In Example 20, the subject matter of any one or more of Examples 1-19 optionally include a cyclone separator located within the debris collector, the cyclone separator configured to separate debris from the debris airstream.

In Example 21, the subject matter of Example 20 optionally includes a screen connected to the cyclone separator, the screen configured to separate debris from the debris airstream.

In Example 22, the apparatuses or method of any one or any combination of Examples 1-21 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A docking station for a mobile cleaning robot, the docking station comprising:

- a base configured to receive at least a portion of the mobile cleaning robot thereon, the base including a debris port;
- a canister connected to the base and located at least partially above the base, the canister comprising:
  - a debris bin to receive debris from the mobile cleaning robot;
  - a debris duct connected to the debris port and to the debris bin; and
  - a debris collector connected to the debris duct upstream of the debris bin, the debris collector configured to collect debris from a debris airstream of the debris duct; and a damper connected to the debris duct upstream of the debris collector, the damper movable between an open position and a bypass position.

2. The docking station of claim 1, further comprising:

a damper actuator connected to the canister and operably connected to the damper, the damper actuator user-operable to move the damper between the open position and the bypass position.

3. The docking station of claim 2, further comprising:

a debris drawer connected to the debris collector and slidably insertable into a collection compartment of the canister between an open position and a closed position.

4. The docking station of claim 3, wherein removal of the debris drawer moves the actuator to the bypass position.

5. The docking station of claim 1, further comprising:

a damper actuator connected to the canister and operably connected to the damper; and a controller in communication with the damper actuator, the controller configured to control the damper actuator to move the damper between an open position and a bypass position.

6. The docking station of claim 5, wherein the controller is configured to receive a debris signal from a debris senor of the mobile cleaning robot, the controller configured to operate the damper actuator based on the debris signal.

7. The docking station of claim 6, further comprising:

a bypass duct connected to the damper, the bypass duct connected to the debris bin, and the bypass duct configured to receive the debris airstream therethrough when the damper is in the bypass position.

8. The docking station of claim 1, further comprising:

a cyclone separator located within the debris collector, the cyclone separator configured to separate debris from the debris airstream.

9. The docking station of claim 8, further comprising:

a screen connected to the cyclone separator, the screen configured to separate debris from the debris airstream.

10. The docking station of claim 1, further comprising:

a screen connected to an outlet of the debris collector, the screen configured to separate debris from the debris airstream.

11. The docking station of claim 1, further comprising:

a baffle located within the debris collector, the baffle configured to separate debris from the debris airstream.

12. The docking station of claim 11, wherein the baffle includes one or more perforations therein or therethrough.

13. The docking station of claim 1, wherein the debris bin is configured to capture or collect dust or hair and the debris collector is configured to capture relatively large debris.

14. A docking station for a mobile cleaning robot, the docking station comprising:

a base configured to receive at least a portion of the mobile cleaning robot thereon, the base including debris port;

a canister connected to the base and located at least partially above the base, the canister comprising:

a debris bin to receive debris from a debris airstream from the mobile cleaning robot; and a debris collector connected to the debris bin and the debris port, the debris collector configured to collect debris from the debris airstream;

an evacuation fan connected to the canister and connectable to the mobile cleaning robot to evacuate debris from a debris bin of the mobile cleaning robot to a debris bag of the canister; and a damper located upstream of the debris collector, the damper movable between an open position and a bypass position.

15. The docking station of claim 14, further comprising:

a damper actuator connected to the canister and operably connected to the damper, the damper actuator user-operable to move the damper between the open position and the bypass position.

16. The docking station of claim 15, further comprising:

a debris drawer connected to the debris collector and slidably insertable into a collection compartment of the canister between an open position and a closed position.

17. The docking station of claim 14, further comprising:

a cyclone separator located within the debris collector, the cyclone separator configured to separate debris from the debris airstream.

18. The docking station of claim 17, further comprising:

a screen connected to the cyclone separator, the screen configured to separate debris from the debris airstream.

* * * * *